US008671629B2

(12) United States Patent
Wu

(10) Patent No.: US 8,671,629 B2
(45) Date of Patent: Mar. 18, 2014

(54) BUILDINGS SEISMIC ISOLATION AND SNUBBER SYSTEM FOR A SEISMIC ISOLATION MECHANISM INSTANTLY ACTIVATED

(76) Inventor: Chyuang-Jong Wu, Sihu Township, Yunlin County (TW)

( * ) Notice: Subject to any disclaimer, the term of this patent is extended or adjusted under 35 U.S.C. 154(b) by 229 days.

(21) Appl. No.: 13/117,350

(22) Filed: May 27, 2011

(65) Prior Publication Data

US 2011/0308175 A1 Dec. 22, 2011

(30) Foreign Application Priority Data

Jun. 22, 2010 (CN) ..... 2010 1 0209948

(51) Int. Cl.

| | |
|---|---|
| ***E04H 9/00*** | (2006.01) |
| ***E04H 14/00*** | (2006.01) |
| ***E04B 1/98*** | (2006.01) |
| ***E04H 9/02*** | (2006.01) |

(52) U.S. Cl.

USPC ..... 52/167.4; 52/1; 52/167.1

(58) Field of Classification Search

USPC ..... 52/1, 167.1, 167.3, 167.4, 167.5, 167.6, 52/167.7, 167.8, 167.9, 573.1; 14/73.5

See application file for complete search history.

(56) References Cited

U.S. PATENT DOCUMENTS

| | | | | |
|---|---|---|---|---|
| 4,881,350 | A * | 11/1989 | Wu | 52/167.5 |
| 4,883,250 | A * | 11/1989 | Yano et al. | 248/638 |
| 5,442,883 | A * | 8/1995 | Nishimura et al. | 52/167.2 |
| 5,689,919 | A * | 11/1997 | Yano | 52/167.6 |
| 6,021,992 | A * | 2/2000 | Yen et al. | 248/560 |
| 6,367,207 | B1 * | 4/2002 | Yamaji et al. | 52/167.6 |
| 7,472,518 | B2 * | 1/2009 | Tsai | 52/167.6 |
| 7,540,117 | B2 * | 6/2009 | Yang | 52/167.4 |
| 7,770,331 | B2 * | 8/2010 | Halloran | 52/1 |
| 8,371,075 | B2 * | 2/2013 | Huber et al. | 52/167.9 |
| 8,429,862 | B2 * | 4/2013 | Yin | 52/167.4 |
| 2002/0166296 | A1 * | 11/2002 | Kim | 52/167.5 |
| 2006/0174555 | A1 * | 8/2006 | Zayas et al. | 52/167.4 |
| 2006/0272225 | A1 * | 12/2006 | Tsai | 52/167.1 |
| 2011/0016805 | A1 * | 1/2011 | Tsai | 52/167.1 |
| 2012/0047822 | A1 * | 3/2012 | Zeevi | 52/167.4 |
| 2012/0174500 | A1 * | 7/2012 | Yakoub | 52/167.4 |

FOREIGN PATENT DOCUMENTS

JP 08277655 A * 10/1995

OTHER PUBLICATIONS

Machine Translation of JP 08277655.*

* cited by examiner

*Primary Examiner* — Ryan Kwiecinski
(74) *Attorney, Agent, or Firm* — Chun-Ming Shih

(57) ABSTRACT

A building's seismic isolation and snubber system for a seismic isolation mechanism instantly activated includes sensors, a processing unit, absorber systems, hydraulic oil pressure systems and multilayer sliding systems. In this regard, a sensor detecting any earthquake-induced strike and dip in a building's quadrant of operation could supply an oblique angle to the processing unit in which the oblique angle thereof is transferred to any hydraulic oil pressure system's coefficient of damping for the hydraulic oil pressure system's corresponding damping force generated to control and distribute a building's equilibrium, and any multilayer sliding system is used to yield or eliminate any seismic horizontal vibrations for the said elements developing all functions, substantially reducing and distributing earthquake-induced stresses, and delivering a building with seismic vibrations effectively isolated and prevented.

4 Claims, 15 Drawing Sheets

BUILDINGS SEISMIC ISOLATION AND SNUBBER SYSTEM FOR A SEISMIC ISOLATION MECHANISM INSTANTLY ACTIVATED

BACKGROUND OF THE INVENTION

1. Field of the Invention

The present invention relates to a building's seismic isolation and snubber system with a seismic wave detection system installed in any building within a seismic region in which there are sensors and a processing unit for a seismic wave signal emitted (or transmitted) from the seismic wave detection system and simultaneously received by the processing unit, pressure relieved by activating previously-installed hydraulic oil pressure systems in a building, a building's weight sustained by the previously designed and installed seismic isolation and snubber system, and any earthquake-induced stress scattered or absorbed for a building's equilibrium. In detail, any information, for instance, a building's strike, dip or horizontal change detected by sensors could be transferred to the processing unit for further interpretation or calculation in which any change of an oblique angle or in a horizontal direction of any quadrant of operation is transferred to the hydraulic oil pressure system's coefficient of damping and the corresponding damping force is regulated by the hydraulic oil pressure system to adjust and distribute a building's equilibrium, so as to deliver any earthquake-induced stress properly controlled and distributed for complete yielding, seismic energy totally absorbed by the absorber systems, and seismic isolation of a building without shaking.

2. Description of the Prior Art

For a long time, the Earth we live is a turbulent environment rich in typhoons and earthquakes.

As a result of uncertain earthquakes with different magnitudes annually raging in any country or region of the top three seismic belts on the Earth, any pitiful sight such as collapsed buildings and wounds attributed to an earthquake (especially a strong destructive earthquake) has been repeatedly displayed to us.

Facing unavoidable acts of God, e.g., earthquakes, people must properly bring their wisdom into full play and combine any accessible technologies such as advanced civil engineering and modern architectural techniques to skillfully develop any earthquake-free building without damage, or the said disasters still threaten living people and become our nightmares. Despite lots of solutions for overcoming earthquake-induced hazards to buildings, human lives or assets offered by skilled persons nowadays, there are still some stubborn defects in their inventions thus far. Before and during development of the present invention, the inventor has collected a great deal of knowledge about root causes of earthquakes, earthquake protection, and multiple earthquake-related technologies or information such as seismic protection, seismic endurance, seismic reduction, seismic prevention, seismic restraint, seismic control, seismic separation, seismic isolation, or seismic absorption, especially all similar inventions or utility model patents declared by patent offices abroad, for further studies, analyses and comparisons. In view of each person's distinct intelligence, specialty, or accumulated experience, each inventor has his (her) own thinking while seeking any consequent solution for the same problem. Undeniably, each invention or innovative design accessible, oncoming, or unavailable but collected in various journals or media (including any theoretical idea significantly different from an actual solution) is worthful so far or applicable to some issues partially; for the earthquake-induced problems, comprehensive and detailed, there are still strong and weak points (or advantages and disadvantages) existing in these disclosed dazzling inventions or innovative designs or among these competitors featuring seismic protection, seismic reduction, seismic prevention, seismic restraint, seismic endurance, seismic separation, seismic isolation, etc. Among all inventions, each of them taking temporary solutions not effecting a permanent cure, effecting a permanent cure not taking temporary solutions, applying wrong methods to any temporary solution and permanent cure, or employing right methods restricted to existing material technologies or external environment cannot keep up with things.

Refer to the Appendix for the patent of "Anti-earthquake structure insulating the kinetic energy of earthquake from buildings" (Taiwan Patent No. 198739; Japan Patent No. 1275821; Canada Patent No. 1323883; U.S. Pat. No. 4,881,350) provided by the inventor two decades ago. Between a building and a foundation separated each other, a supporting isolation layer with a plurality of curved ball seats on its upper and lower surfaces and a plurality of corresponding balls installed for ultra-low frictional thrust between curved ball seats and corresponding balls skillfully contributes to earthquake-induced horizontal kinetic energy from destructive horizontal shakes transferred to a building's vertical potential energy due to balls and curved ball seats reciprocally rolling during an earthquake. In virtue of a multilayer design in balls and supporting isolation layers, any earthquake-induced horizontal shakes express a bottom-up decay geometrically and little kinetic energy is transmitted to a building finally. Additionally, a plurality of linkage snubbers installed between any support isolation layer and a building are effective in earthquake-induced vertical kinetic energy transferred to sliding shoes' horizontal kinetic energy and further proportionally absorbed by bow buffer springs based on the lever principle for delivering a building's safety without direct destroy from impact of earthquake-induced vertical shakes. Defect 1: Despite a horizontal motion between ball seats and corresponding balls for generation of the minimum rolling frictional thrust and little adverse effect from earthquake-induced horizontal shakes on a building, the application of the invention is limited to a light building only rather than a large-scale building which cannot sustain huge pressures out of contact forces between balls and ball seats (point-to-point contact) or huge stress per unit area. Defect 2: In spite of an intrinsic clever design to overcome impact on a building due to earthquake-induced vertical shakes proportionally absorbed by bow buffer springs based on linkage snubbers in the invention and the lever principle, a building's huge weight is still sustained by the snubbers even without disturbance of any earthquake and consequently causes elastic fatigue of components in the linkage shock absorption system and curtails their service lives such as linkages and bow springs under huge pressures. Also, a plurality of balls and linkage snubbers designed to sustain an entire building and effective in its intrinsic seismic isolation and protection function during an earthquake usually rock and disturb residents who live above the apparatus without any extra protection mechanism designed to overcome wind pressure in one windy area with any blast raging (or any region with typhoons or hurricanes frequently occurring). Despite its obviously potential values based on the said descriptions, each earthquake-related invention or utility model patent still has any defect more or less or a blemish in an otherwise perfect thing comparatively thus far. In consideration of existing well-developed technologies and relevant information for long-term thinking and research to achieve mastery through a comprehensive study and touch the core issue from a macro view, the inventor skillfully integrate modern technologies such as electronics, communications, hydraulic crane, mechanics, etc. into the original invention herein for seismic isolation and prevention by means of these techniques thereof cooperating one another and separately developing their total functions. It is believed that the present invention with exquisite design, arrangement and planning is able to express its flawless performance and fulfill "safe residence" for people while confronting any act of God, typhoon or earthquake.

The technical philosophy and measures adopted in the invention herein have supplied reliable safety and earthquake-free protection to most buildings. However, a tiny vibration during any manufacture or process still leads to any irretrievable loss in some specific industries or locations emphasizing an ultra-high aseismatic environment such as FAB, hospital for surgery or microsurgery, critical information storage center, museum with some important cultural heritages or priceless antiques collected within, and any other high-precision high-tech industry.

Depending on spirit to strive for perfection in the principle or structure of the said invention, the inventor continues research and development in detail to create elaborate design for any hazard attributed to micro-earthquake in the said industry thoroughly excluded and no risk threatening specific industries or locations hereinabove in spite of any earthquake.

SUMMARY OF THE INVENTION

The object of the present invention is to provide a building's seismic isolation and snubber system which depends on a building separated from its foundation and hydraulic oil pressure systems sustaining the building and comprises indoor sensors detecting the building's oblique angles and a processing unit computing the building's any tilt for damping forces generated by the hydraulic oil pressure systems to distribute and control the building's equilibrium during an earthquake.

The other object of the present invention is to provide a building's seismic isolation and snubber system with the hydraulic oil pressure systems installed around a building to prevent the building from damage attributed to seismic waves.

The further object of the present invention is to provide a building's seismic isolation and snubber system with a processing unit, which automatically determines the priority of corresponding damping forces according to any strike or dip in a quadrant of operation, and deliver an equilibratory building increasingly or decreasingly in multi-frequency.

The building's seismic isolation and snubber system delivering the said objects comprises:

Absorber systems under a building are the systems with first bearing carriers underneath and used to eliminate a building's vertical and horizontal vibrations;

Multilayer sliding systems installed under the absorber systems comprise any second bearing carrier with a sliding shoe below at which the sliding shoe's bottom contacts a multilayer stack structure composed of several units of dish gliding slabs with sizes gradually changed and concave surfaces to yield or eliminate any earthquake-induced horizontal vibrations;

Hydraulic oil pressure systems arranged with the multilayer sliding systems at regular intervals are used to sustain a building or eliminate any load applied to a building;

A processing unit electrically connected to the hydraulic oil pressure systems is used to receive seismic wave signals and activate the hydraulic oil pressure systems to eliminate any load applied to a building, and further comprises: sensors installed indoors for detecting a building's oblique angles and connected to the processing unit; the absorber systems and hydraulic oil pressure systems installed underneath to the building wherein:

The sensors installed inside a quadrant unit of a building provide information such as oblique angle to the processing unit in which any tilt is determined and controlled and any oblique angle in one quadrant of operation is transferred to one hydraulic oil pressure system's coefficient of damping for the building's equilibrium distributed and controlled by the hydraulic oil pressure systems based on corresponding damping forces in the event of any strike and dip in the building's quadrant of operation.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
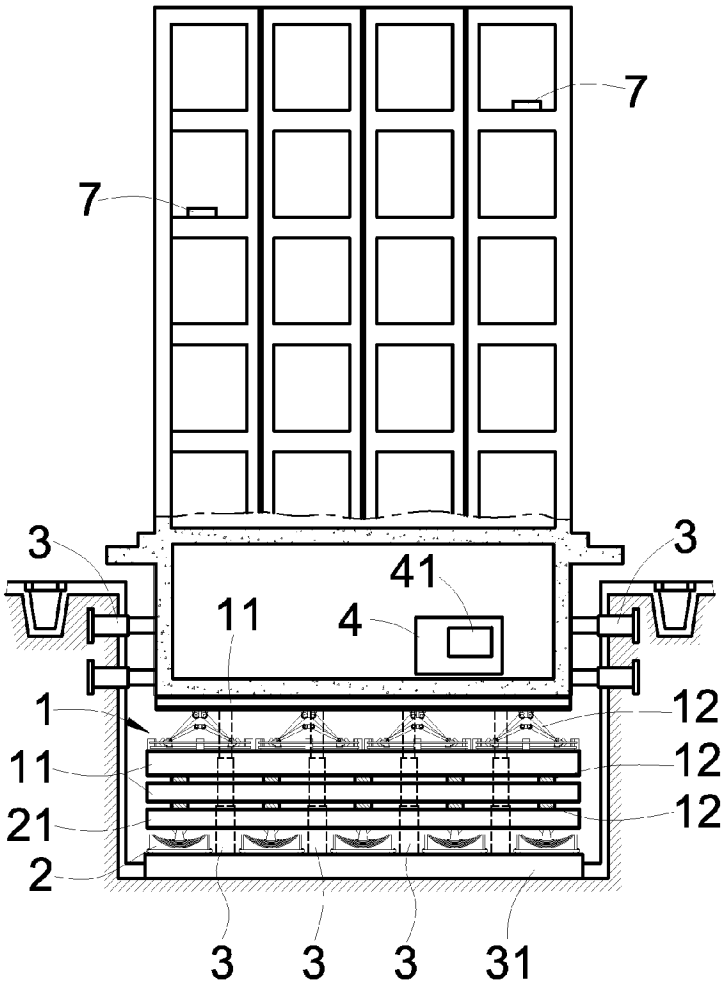
FIG. 1 illustrates the sectional view of the first embodiment for the present invention of a building's seismic isolation and snubber system not activated.
Figure 3:
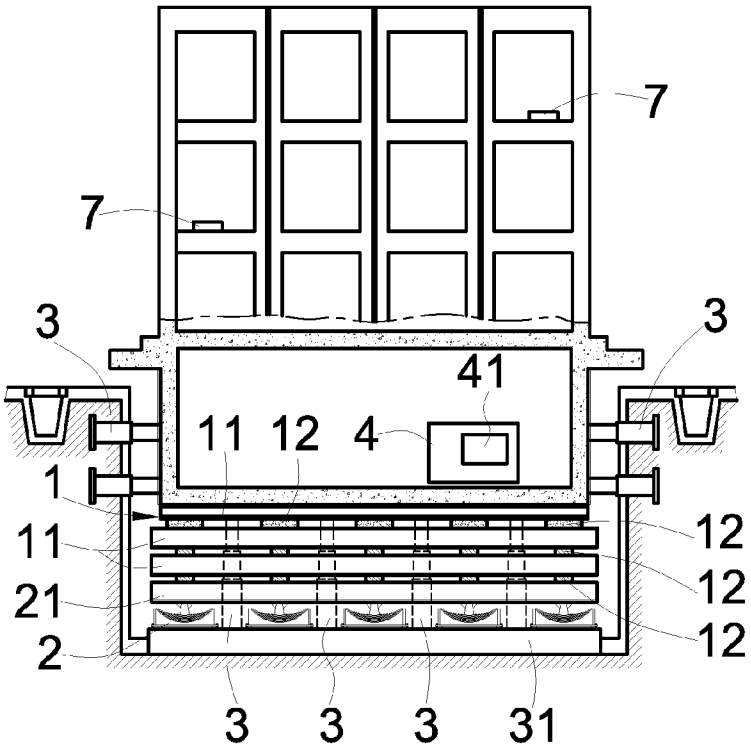
FIG. 3 illustrates the sectional view of the second embodiment for the present invention not activated.
Figure 20:
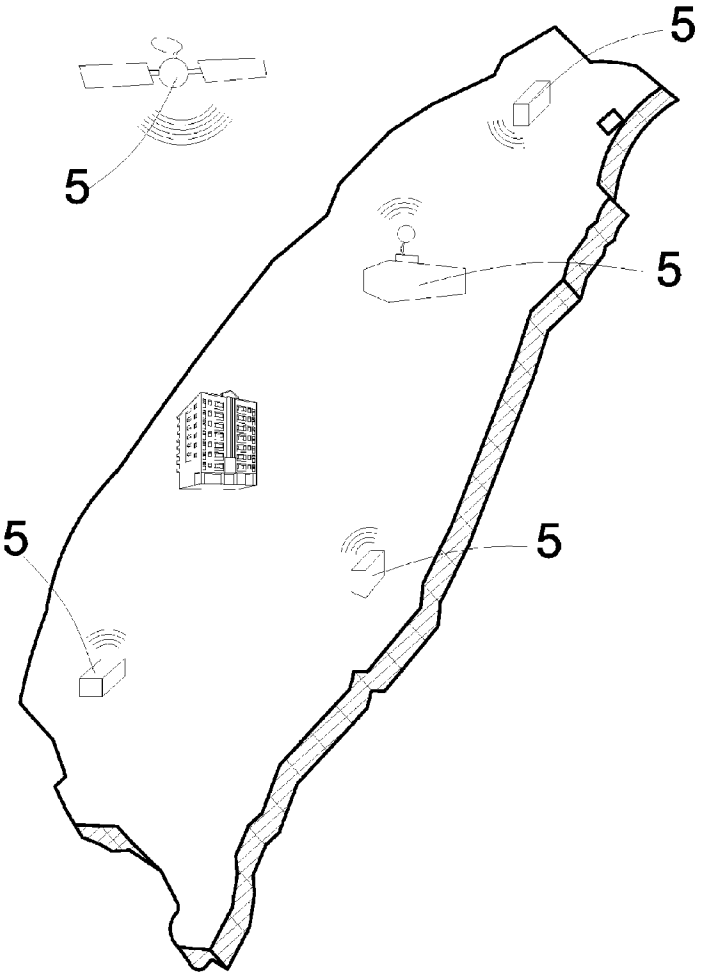
FIG. 20 illustrates positions of the seismic wave detection system distributed everywhere for seismic wave signals transmitted to the processing unit via the system thereof.
Figure 22:
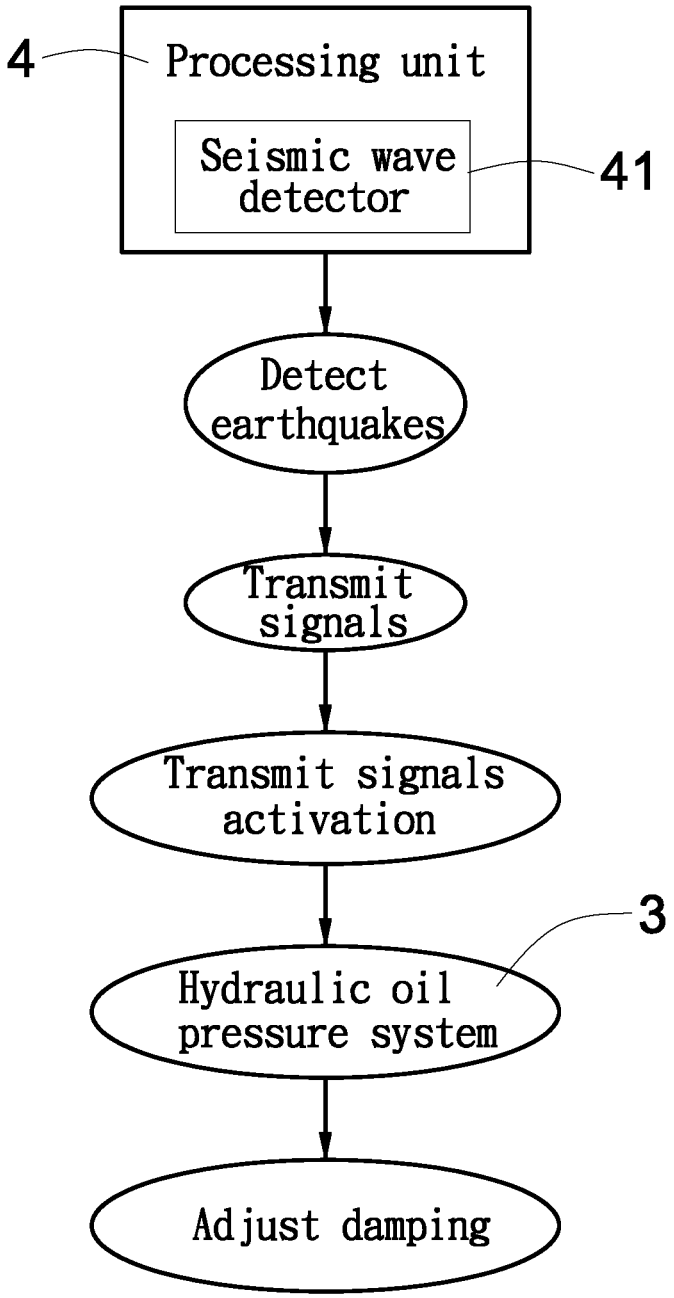
FIG. 22 is the block diagram of another embodiment for the present invention activated.
Figure 23:
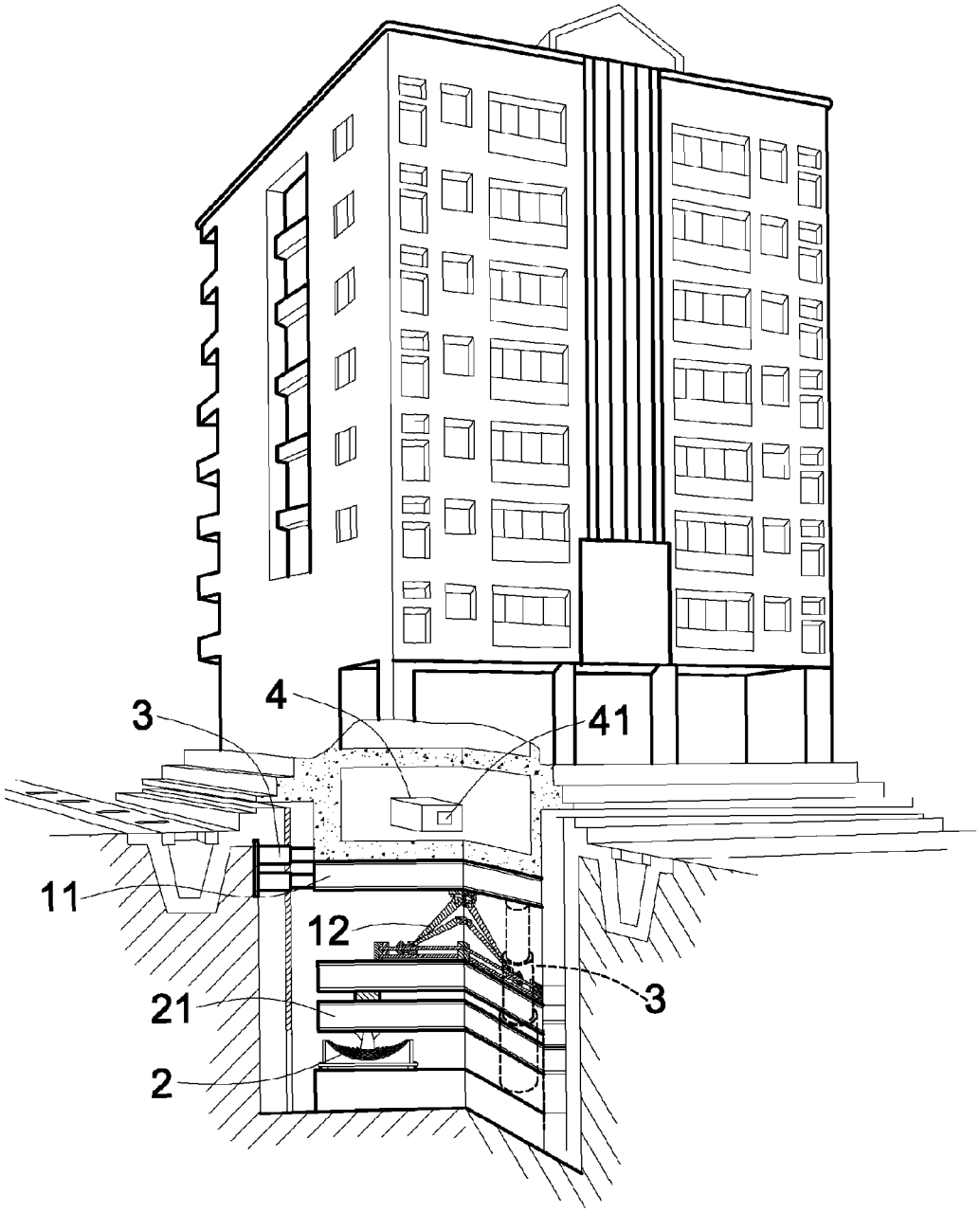
FIG. 23 is the perspective view of the specific embodiment for the present invention.

Referring to FIGS. 1, 3 and 20 which illustrate the building's seismic isolation and snubber system in the present invention comprises absorber systems 1, multilayer sliding systems 2, hydraulic oil pressure systems 3, and a processing unit 4.

Figure 2:
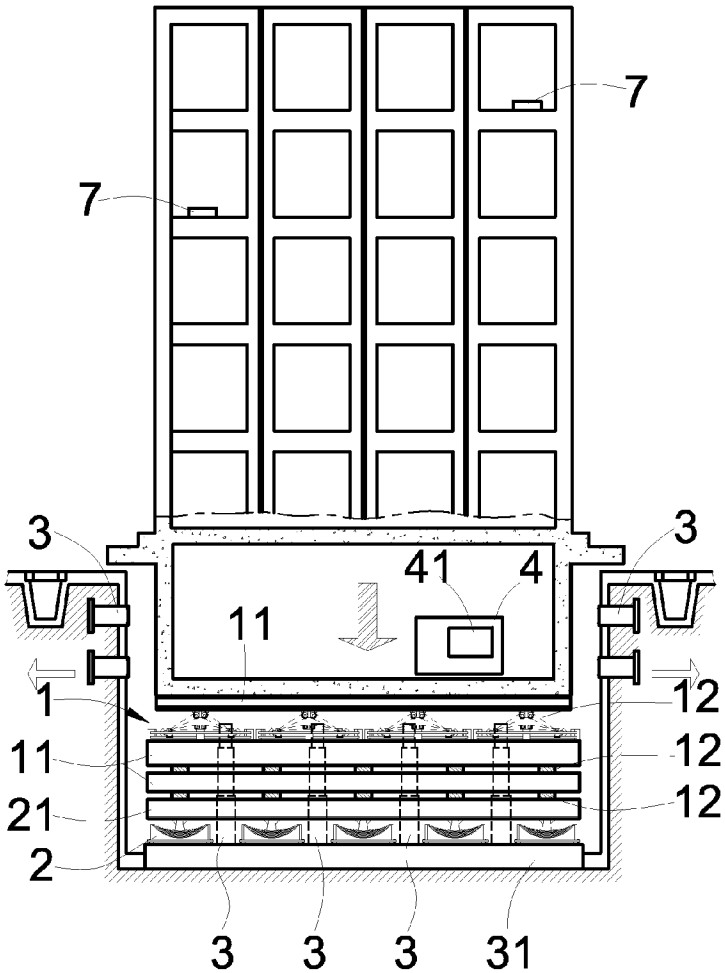
FIG. 2 illustrates the schematic diagram of the first embodiment for a seismic isolation mechanism of the present invention activated.
Figure 4:
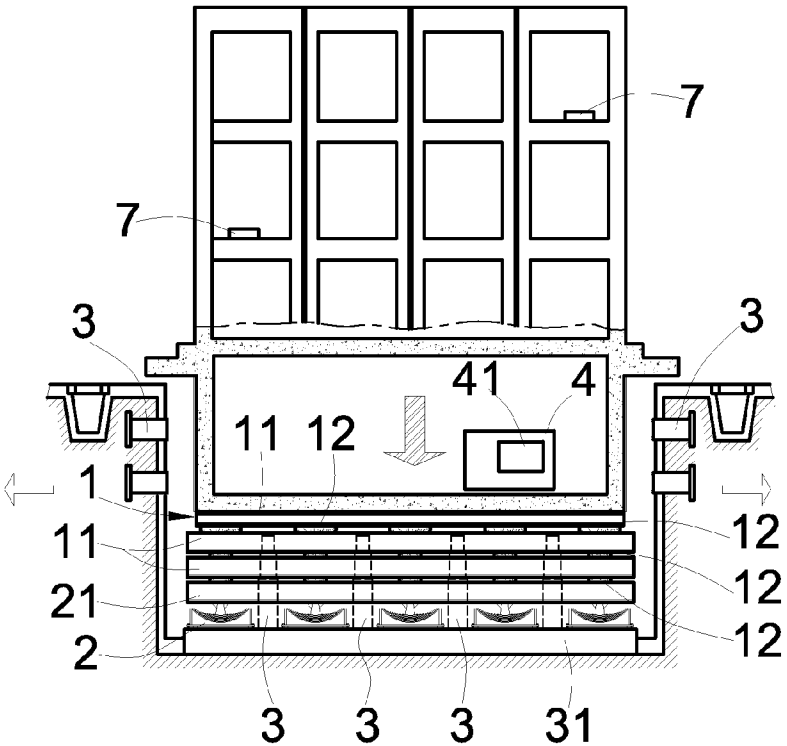
FIG. 4 illustrates the schematic diagram of the second embodiment for a seismic isolation mechanism of the present invention activated.
Figure 5:
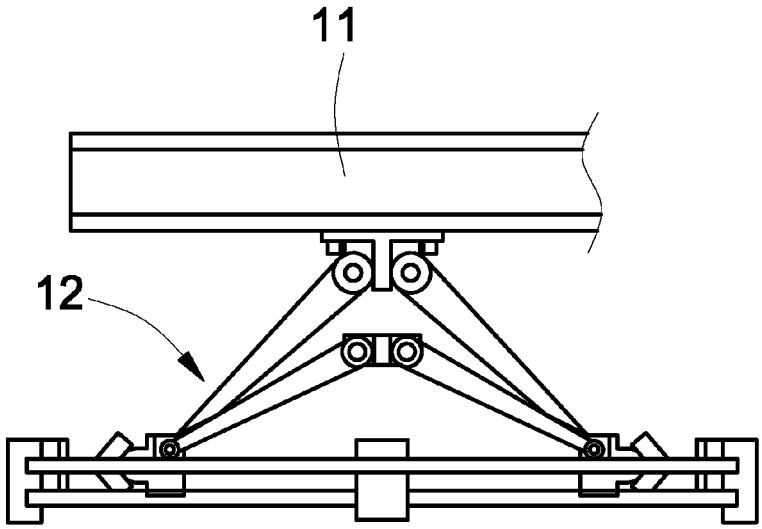
FIG. 5 is the appearance of one absorber system in the present invention to illustrate the absorber system comprising linkage snubbers.
Figure 6:
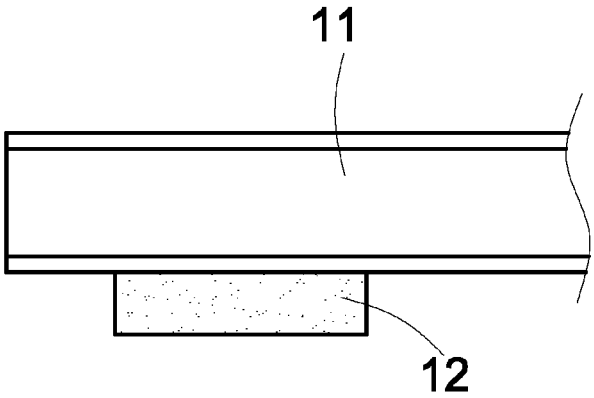
FIG. 6 illustrates the appearance of one absorber system in the present invention to illustrate the absorber system comprising elastomers.

The absorber systems 1 under a building are the systems comprising first bearing carriers 11 with snubbers 12 underneath used to eliminate a building's vertical and horizontal micro-vibrations; as shown in FIGS. 1, 2 and 5, the absorber systems 1 provided with linkage snubbers contribute to vertical kinetic energy, which is applied to a building by its foundation, transferred to the linkage snubbers' elastic potential energy for a seismic isolation effect in the vertical direction; as shown in FIGS. 3, 4 and 6, the absorber systems 1 are also provided with elastomers as buffers to absorb vertical vibrational kinetic energy applied on a building by an earthquake and prevent a building from damage during an earthquake; alternatively, the absorber systems 1 with the linkage snubbers and the elastomers integrated effectively eliminates a building's vertical and horizontal vibrations.

Figure 7:
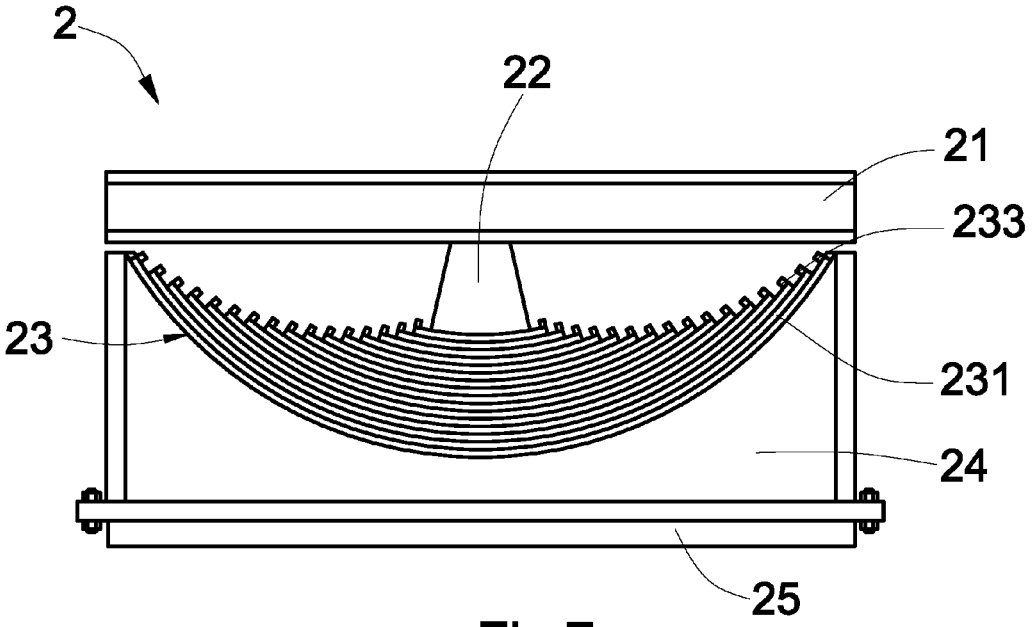
FIG. 7 illustrates the sectional view of a multilayer stack structure in the present invention.

The multilayer sliding systems 2 installed under the absorber systems 1 comprise any second bearing carrier 21 provided with a sliding shoe 22 underneath which makes its bottom contact a multilayer stack structure 23 composed of several units of dish gliding slabs 231 with the same size (FIG. 7) and are developed to a column in general with a bottom curved inside out, designed to be a certain curvature, and contacting a top dish gliding slab 231 of any multilayer stack structure 23. The dish gliding slab 231 has a centrally concave dish curve tightly connecting and corresponding to the sliding shoe and closely contacts another dish gliding slab 231 underneath to develop all layers of dish gliding slabs 231 mutually tightly contacting in the same way, and the dish gliding slab 231 on the lowest layer also closely contact a hemispheric socket 24 with a similar concave surface. In the said multilayer sliding system 2, a wear-resistant and sliding material is coated, plated or stuck on every contiguous contacting surfaces and an elastic energy-absorbing cushion packing 25 is filled in the bottom of the socket 24 and fixed on the foundation with bolts. The overall dimension of assembled dish gliding slabs 231 in the multilayer stack structure 23 is expressed in a bottom-up decreased style (FIG. 7, FIG. 8, FIG. 10 and FIG. 11); the data such as thickness, quantity, radius, area or curvature of assembled dish gliding slabs 231 are developed to be any combination according to a realistic demand.

Also, the dish gliding slabs 231 are sequentially stacked and assembled to be a taper multilayer stack structure 23; in the event of any earthquake, the sliding shoe 22 reciprocally swinging in the direction of a force applied makes any two dish gliding slabs 231 mutually sliding to eliminate any earthquake-induced horizontal stress but no dish gliding slab 231 under the swinging force thereof detached due to a flange 233 on the edge of each dish gliding slab 231; the sliding shoe 22 installed in a curved space of the top dish gliding slab 231 reciprocally swings in the direction of a force applied during an earthquake and makes all dish gliding slabs 231 mutually glide to eliminate any stress.

Figure 8:
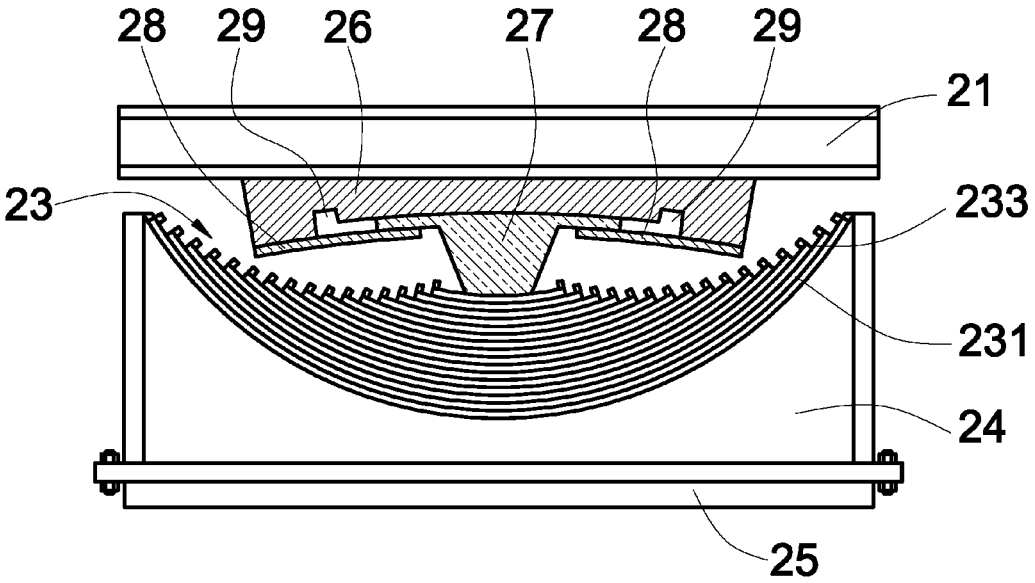
FIG. 8 illustrates the sectional view of another embodiment of the multilayer stack structure in the present invention.

FIG. 8 illustrates another embodiment of one multilayer sliding system 2. The multilayer sliding system 2 comprises a concave socket 26 downward in which a T-type (or reverse Ω-type) sliding shoe 27 with the same radian is accommodated wherein the T-type sliding shoe 27 has a centrally cambered surface at the top tightly corresponding to the concave socket 26 downward, a cambered surface downward at the bottom closely contacting the top concave surface of the assembled dish gliding slabs, and some various holes and spiral or radial grooves distributed around for stored or applied lubricant (grease) easily permeating (lubricating) the corresponding sliding devices, any coefficient of kinetic friction substantially reduced and earthquake-induced horizontal vibrations yielded during any reciprocal slide between the T-type sliding shoe 27 and the corresponding socket activated in an earthquake. Attached to the lower surface of the T-type sliding shoe 27, a hollow circular plate 28 with the same radian is fixed on the concave socket 26 downward with bolts wherein there is one space between these two components thereof provided to the T-type sliding shoe 27 for a proper horizontal slide without detachment.

Prepared in the said apparatus, some accommodating spaces 29 are used in storing grease or lubricant injected inside for sliding devices. Any horizontal displacement of the biconcave multilayer surface sliding device is much greater than that of a concave multilayer stack structure 23. Still, both devices thereof are effective in earthquake-induced horizontal vibrational kinetic energy transferred into a building's vertical potential energy and allow a building to return to its lowest and most stable position with an earthquake disappearing.

Figure 9:
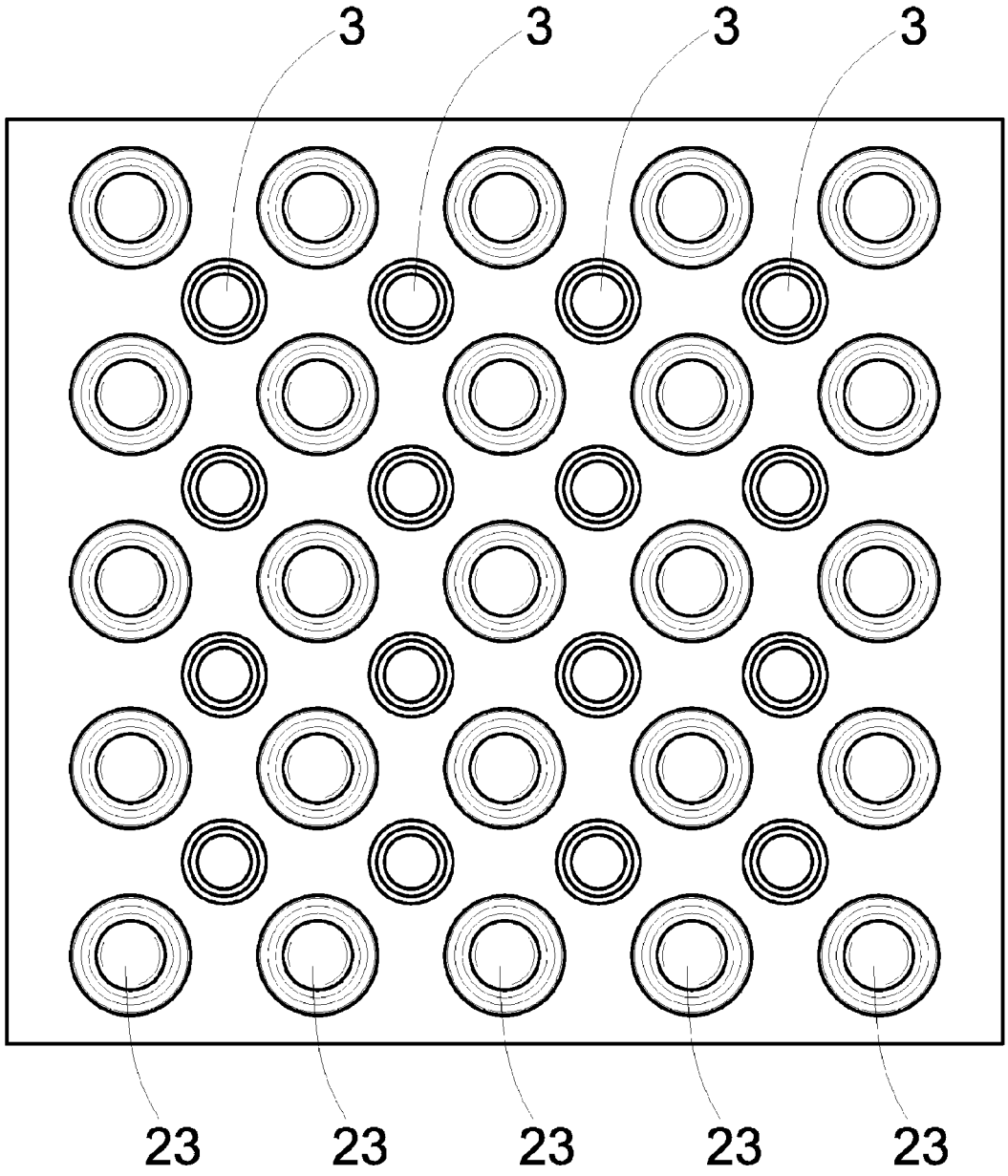
FIG. 9 illustrates configurations of the multilayer stack structures and the hydraulic oil pressure systems in the present invention.
Figure 11:
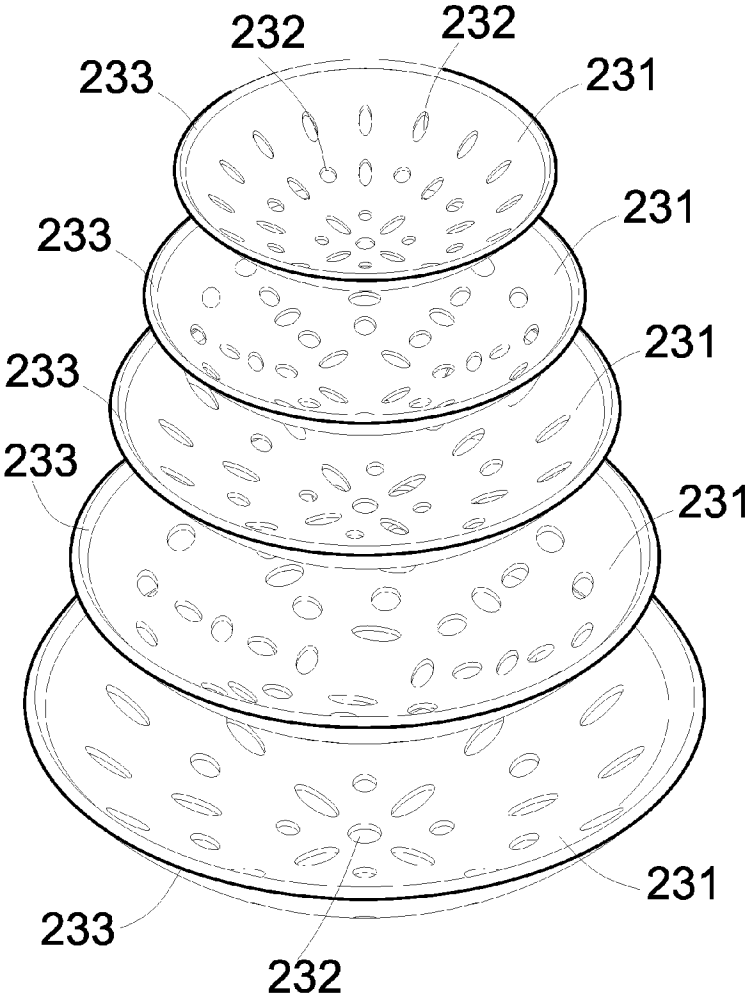
FIG. 11 illustrates the perspective view of another embodiment for dish gliding slabs of the multilayer stack structure in the present invention.
Figure 10:
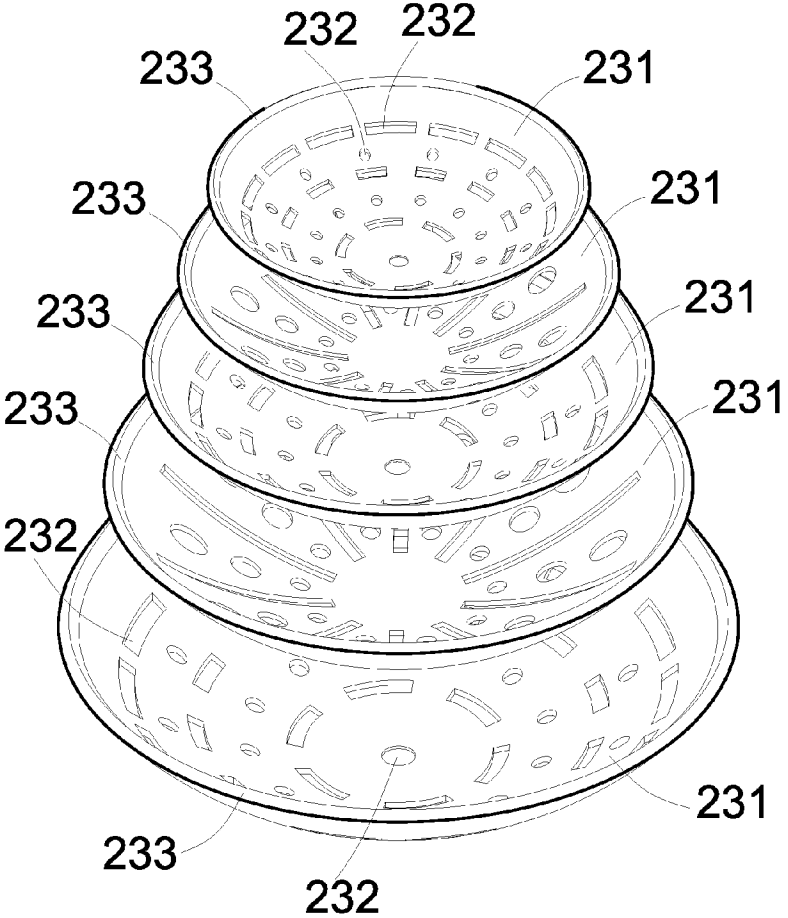
FIG. 10 illustrates the perspective view of dish gliding slabs of the multilayer stack structure in the present invention.

Referring to FIG. 9 which illustrates the hydraulic oil pressure systems 3 arranged with the multilayer sliding systems 2 at regular intervals to sustain a building and eliminate any load applied to the building. In the hydraulic oil pressure systems 3, some consumables of an earthquake-free building such as snubbers 12 could be renewed regularly, or any multilayer stack structure 23 could be resupplied, replaced, or maintained regularly or after an earthquake wherein any operation thereof directly performed without any auxiliary tool (e.g., crane) is taken as another extra function of the present invention.

As shown in FIG. 1 or FIG. 3, there are at least two units of hydraulic oil pressure systems 3 supporting and stabilizing a building at its bottom and periphery for the building alternately sustained by the systems thereof. Also, the several units of hydraulic oil pressure systems 3 used in supporting a building's periphery or laterals protect a building from shakes attributed to strong wind and prevent residents inside from discomfort.

The processing unit 4 electrically connected to the hydraulic oil pressure systems 3 is used to receive any seismic wave and activate the hydraulic oil pressure systems 3 to eliminate any load applied to a building; the seismic wave detection system 5 installed at a regular interval is used to detect any seismic wave by which the system thereof generates a signal matching a time information, as shown in FIG. 20. The building's seismic isolation and snubber system further comprises a seismic wave detection system 5 to which the processing unit 4 based on general or wireless communications is connected for reception of seismic wave signals and generation of a warning signal according to a guideline; in practice, the seismic wave detection system 5 further comprises a communications device by which the seismic wave detection system 5 can transmit a signal to the processing unit 4 for the hydraulic oil pressure systems 3 activated by the processing unit 4 to eliminate any load applied to a building with an earthquake detected, so that both the absorber systems 1 and the multilayer sliding systems 2 bring their functions in seismic isolation into full play for safety of a building;

The communications device further comprises a radio detection system transmitting the warning signal to the processing unit 4 via a radio transmission network such as an Ultra High Frequency (UHF), a Very High Frequency (VHF), a mobile phone communications network, and a fixed network; in practice, the communications device comprises a satellite signal detection system for the warning signal transmitted to the processing unit 4 via a satellite, for instance, a maritime satellite. The processing unit 4 is provided with a built-in reception device used in receiving any seismic signals emitted (or transmitted) from the seismic wave detection system 5 of a remote earthquake monitoring station. Transferred from an instantly arriving seismic wave detected by the seismic wave detection system 5 and emitted (or transmitted) via an emission (or transmission) device activated by the seismic wave detection system 5, the seismic wave signal is received by the processing unit 4 for both an earthquake-free building's default hydraulic oil pressure systems 3 as well as a seismic isolation mechanism enabled to ensure a building's safety.

To prevent a building from attack of consequent seismic waves and ensure safety, the seismic wave detector 41 in the processing unit 4 is one back-up system which is effective in simultaneously delivering a seismic wave signal to the hydraulic oil pressure systems 3 and activating the hydraulic oil pressure systems 3 to eliminate any load applied to a building in case of the said seismic wave detection system 5 out of order and disabled (FIG. 2 and FIG. 4). According to the present invention of the building's seismic isolation and snubber system, the processing unit 4 should activate the hydraulic oil pressure systems 3, i.e., both the hydraulic oil pressure systems 3 sustaining a building (partially or completely) as well as the hydraulic oil pressure systems 3 regularly supporting a building's periphery, to relieve all pressures, and the earthquake-free structure designed and installed in advance should sustain a building's total weight for recovery of the building's horizontally relative movement.

The processing unit 4 further comprises a configuration editor attached to the seismic wave detector 41 or the processing unit 4 and cooperating with one computer to define a specific magnitude for one building as a threshold of allowing the building's seismic isolation mechanism to be automatically activated by the processing unit 4.

A sensor 7 installed in a building's quadrant unit should provide and collect any information with respect to oblique angles (or horizontal changes) to the processing unit 4 for further determination, control and calculation in case of any strike or dip detected in the building's quadrant of operation, and the processing unit 4 should transfer any oblique angle in a quadrant of operation into a coefficient of damping for one hydraulic oil pressure system 3, which depends on a corresponding damping force to control or distribute equilibrium of a building, and automatically determine the priority of the corresponding damping forces thereof based on the strike or dip in the quadrant of operation.

The hydraulic oil pressure systems 3 vertically erected on the third bearing carrier 31 ordinarily supports and fixes a building; the processing unit 4 based on any oblique angle in a quadrant of operation controls a coefficient of damping for each hydraulic oil pressure system 3 and drives the hydraulic oil pressure systems 3 to apply corresponding damping forces used in controlling and distributing equilibrium of one building during an earthquake. Also, there are several units of horizontal hydraulic oil pressure systems 3 installed on a building's periphery or laterals for assistant support to prevent a building under effect of strong wind from any shake and distribute the said equilibrium of one building in case of an earthquake detected.

The said descriptions are one preferred embodiment of the present invention of a building's seismic isolation and snubber system for each component and installation; then, the method of employing the present invention and its characteristics are further introduced as follows:

Referring to FIG. 1 and FIG. 3 first which illustrate a building's bottom and periphery supported by absorber systems 1 and hydraulic oil pressure systems 3 installed in place to protect snubbers 12 in the absorber systems 1 sustaining a building's weight chronically from elastic fatigue, material fatigue, or aging and extend any element's service life. As shown in FIG. 9, the hydraulic oil pressure systems 3 arranged with the multilayer sliding systems 2 at regular intervals are used to sustain a building or eliminate any load applied to a building. A building supported by the hydraulic oil pressure systems 3 vertically and horizontally is able to endure wind pressure without wind-induced swing or shake. Any maintenance or replacement of an element (such as elastomer in a snubber 12) could be performed with the hydraulic oil pressure systems 3 themselves rather than any other cranes supporting a building. Between a building and any hydraulic oil pressure system 3, there are some first bearing carriers 11 installed to support a building without its bottom damaged by any hydraulic oil pressure system 3 during distribution of damping forces. Any first bearing carrier 11 is provided with some snubbers 12 at its top to absorb earthquake-induced vertical vibrational kinetic energy applied to a building and protect a building from an earthquake-induced damage for a building's vertical and horizontal vibrations effectively reduced. Also, some micro-vibrations during damping forces distributed by the hydraulic oil pressure systems 3 are absorbed by the snubbers 12 for an extended service life of any hydraulic oil pressure systems 3.

Figure 12:
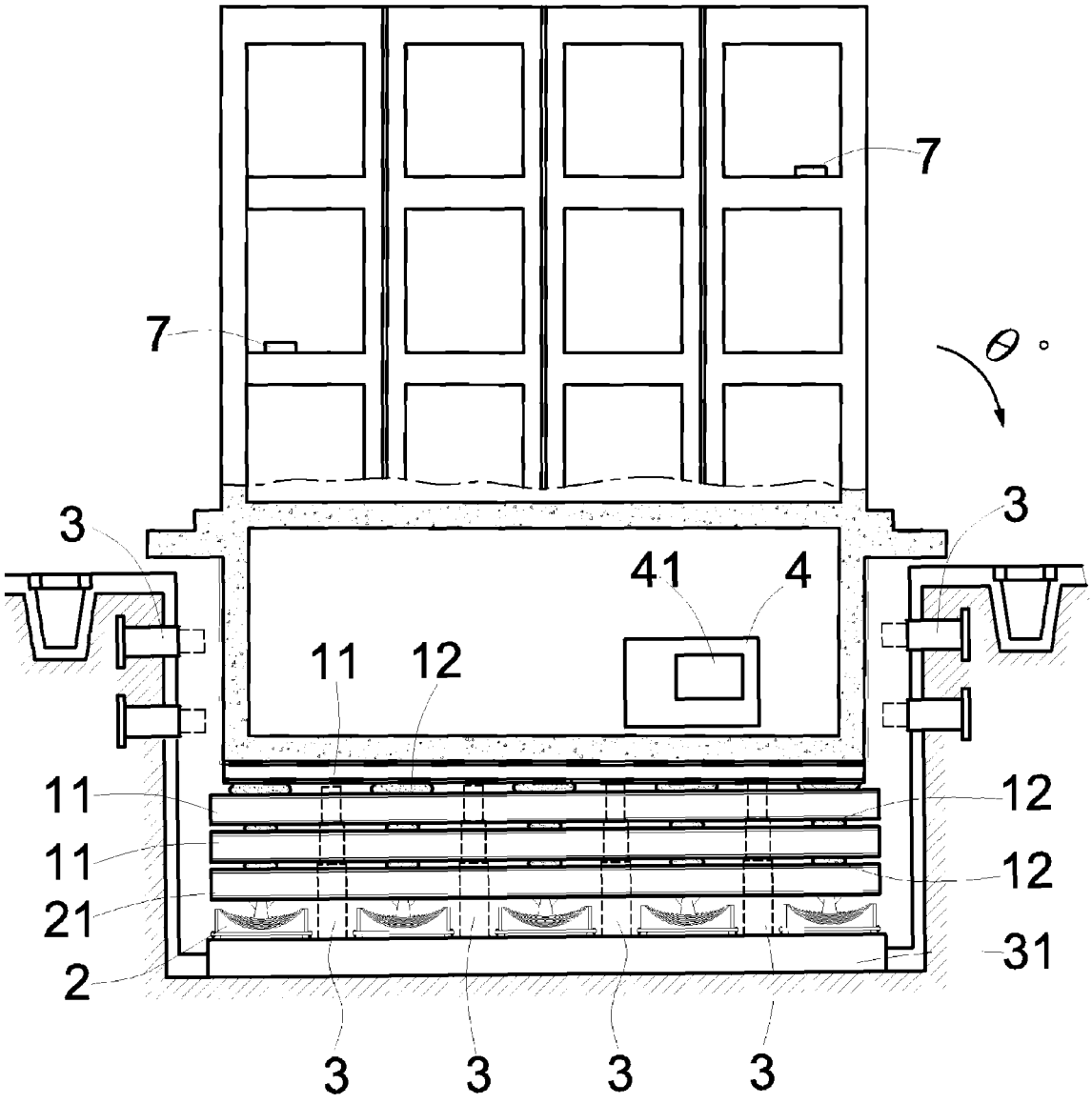
FIG. 12 and FIG. 13 illustrate a dip in the quadrant A during an earthquake.
Figure 13:
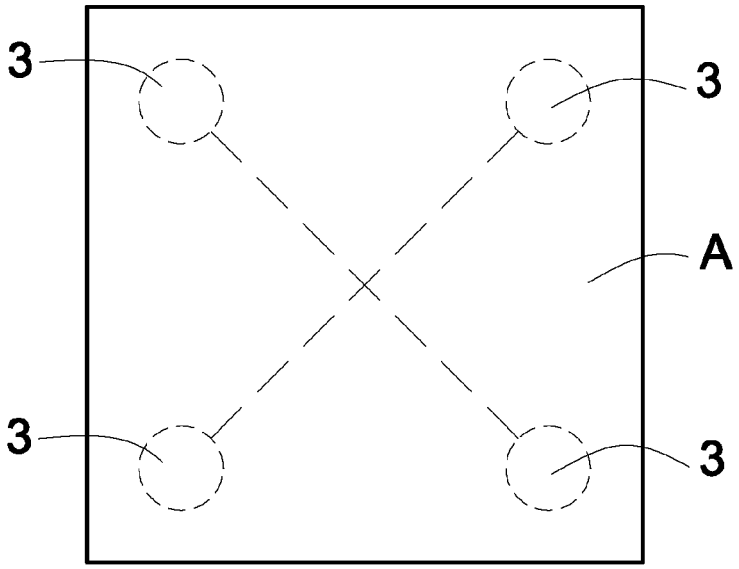
Figure 14:
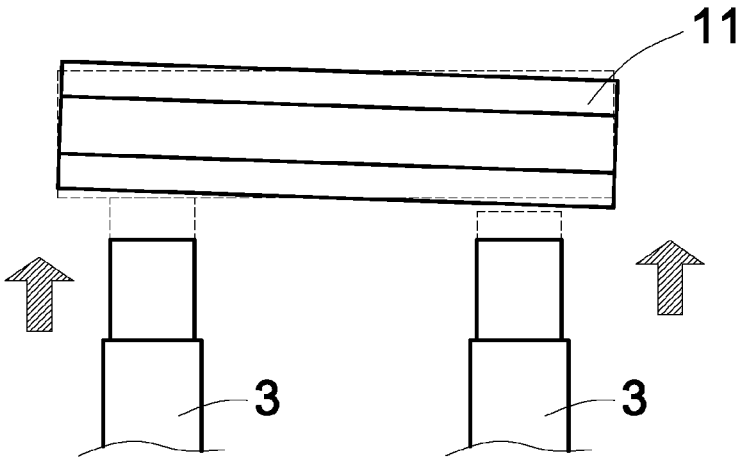
FIG. 14 is the schematic diagram to illustrate damping forces adjusted by the hydraulic oil pressure systems based on coefficients of damping calculated by the processing unit.
Figure 15:
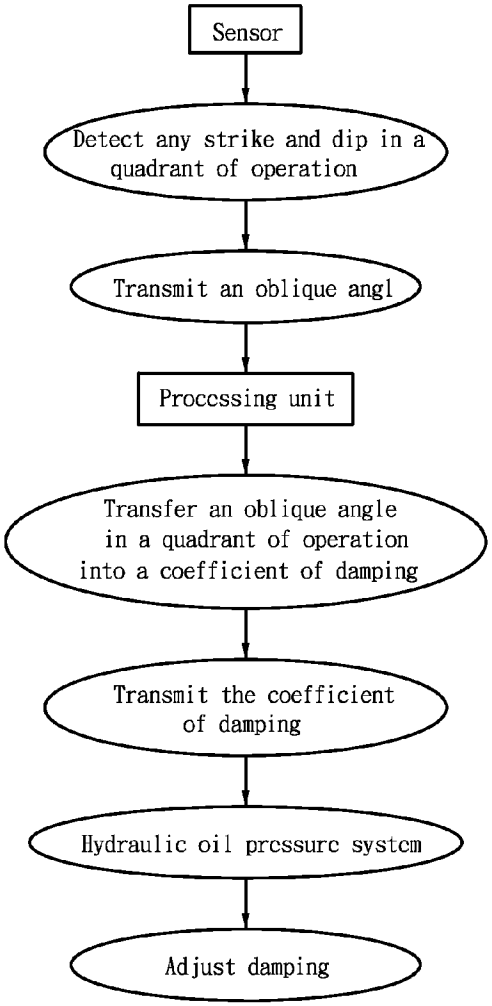
FIG. 15 is the block diagram to illustrate a seismic isolation mechanism of the present invention.

Referring to FIG. 2, FIG. 4 and FIG. 12 which illustrate the processing unit 4 connected to sensors 7 is electrically connected to the hydraulic oil pressure systems 3 for seismic wave signals collected to activate the hydraulic oil pressure systems 3 and eliminate load, i.e., a building's vertical and horizontal pressures sustained by the hydraulic oil pressure systems 3 are slowly relieved to a certain degree and a building' total weight is transferred and further supported by the seismic isolation and snubber system designed and installed in advance for a building's relative horizontal movement restored. Meanwhile, a building's oblique angle attributed to any strike and dip in a quadrant of operation should be detected by the sensors 7 installed inside a building and delivered to the processing unit 4 for determination and control of any detected tilt;

Referring to FIGS. 13, 14 and 15 which illustrate a dip of quadrant A wherein any oblique angle coming from a vertical or horizontal dip detected by the sensor 7 is transmitted to the processing unit 4 for a coefficient of damping of each hydraulic oil pressure systems 3 in the quadrant A adjusted by the processing unit 4 based on the oblique angle thereof and a building's equilibrium controlled and distributed by corresponding damping forces under commands of the hydraulic oil pressure systems 3 without a building tiled or damaged. It deserves to be mentioned that kinetic energy finally transmitted to a building is very little owing to the damping forces from the hydraulic oil pressure systems 3 adjusted increasingly or decreasingly in multi-frequency.

Figure 16:
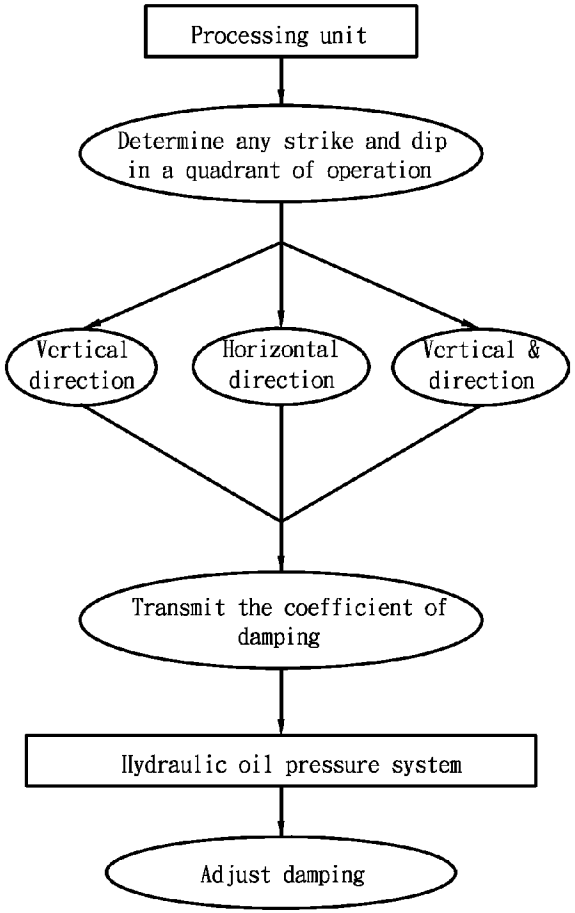
FIG. 16 is the block diagram to illustrate dip in a quadrant of operation determined by the processing unit.

Moreover, as shown in FIG. 16, the processing unit 4 in the present invention could automatically determine to drive the hydraulic oil pressure systems 3 along the vertical direction only (horizontal direction only or both vertical and horizontal directions) for any vertical (horizontal or vertical and horizontal) dip and strike in a quadrant of operation and equilibrate a building while accepting any oblique angle attributed to any dip and strike in a quadrant of operation; in a word, the processing unit will automatically determine and drive the vertical hydraulic oil pressure systems 3 in quadrant A to adjust damping forces according to any oblique angle delivered by the sensors 7 in case of any vertical strike or dip in quadrant A, drive the horizontal hydraulic oil pressure systems 3 in quadrant A to change damping forces in case of a vertical strike or dip in quadrant A, or drive both vertical and horizontal hydraulic oil pressure systems 3 in quadrant A to regulate damping forces in case of vertical and horizontal strikes or dips in quadrant A. In this way, a building could be kept in vertical status anytime without any tilt.

In case of any earthquake-induced horizontal vibration, the sliding shoes 22 on the multilayer stack structures 23 reciprocally swinging in the direction of any force applied generate lots of relative slides among dish gliding slabs 231 or between dish gliding slabs 231 and their sockets 24 to eliminate any earthquake-induced horizontal stress wherein each dish gliding slab 231 is provided with a flange 233 on its edge in favor of no dish gliding slab 231 detached under a swinging force and the absorber systems 1 alleviating or absorbing any vertical and horizontal micro-vibrations for reliable and safe protection of a building.

Also, there are some rectangular or long elliptic holes 232 without uniform sizes are distributed on each dish gliding slab 231 of a multilayer stack structure 23 wherein all rectangular or long elliptic holes on any two contiguous dish gliding slabs 231 are arranged in crisscross patterns for grease or lubricant applied or stored and uniformly permeating or lubricating all multilayer sliding systems 2 as well as all sliding elements (e.g., sliding shoes 22, dish gliding slabs 231 and sockets 24) and any coefficient of kinetic friction between any two elements in a multilayer sliding system 2 (i.e., a sliding shoe 22 and a dish gliding slab 231, any two dish gliding slabs 231, or a dish gliding slab 231 and a socket 24) substantially reduced in case of any relative replacement or reciprocal slide of the dish gliding slabs 231 attributed to earthquake-induced horizontal vibrations; in general, any kinetic energy from earthquake-induced horizontal vibrations is transmitted between the layers of low-frictional sliding elements, decayed geometrically and absorbed by any snubber 12 installed on a first bearing carrier 11 so that there is very little vibrational energy transferred to a building at which the almost earthquake-free status is delivered. Additionally, a building could still return to its originally lowest and most stable position because of any earthquake-induced horizontal kinetic energy transferred to a building's vertical potential energy by the dish gliding slabs 231 with an earthquake disappearing.

Figure 17:
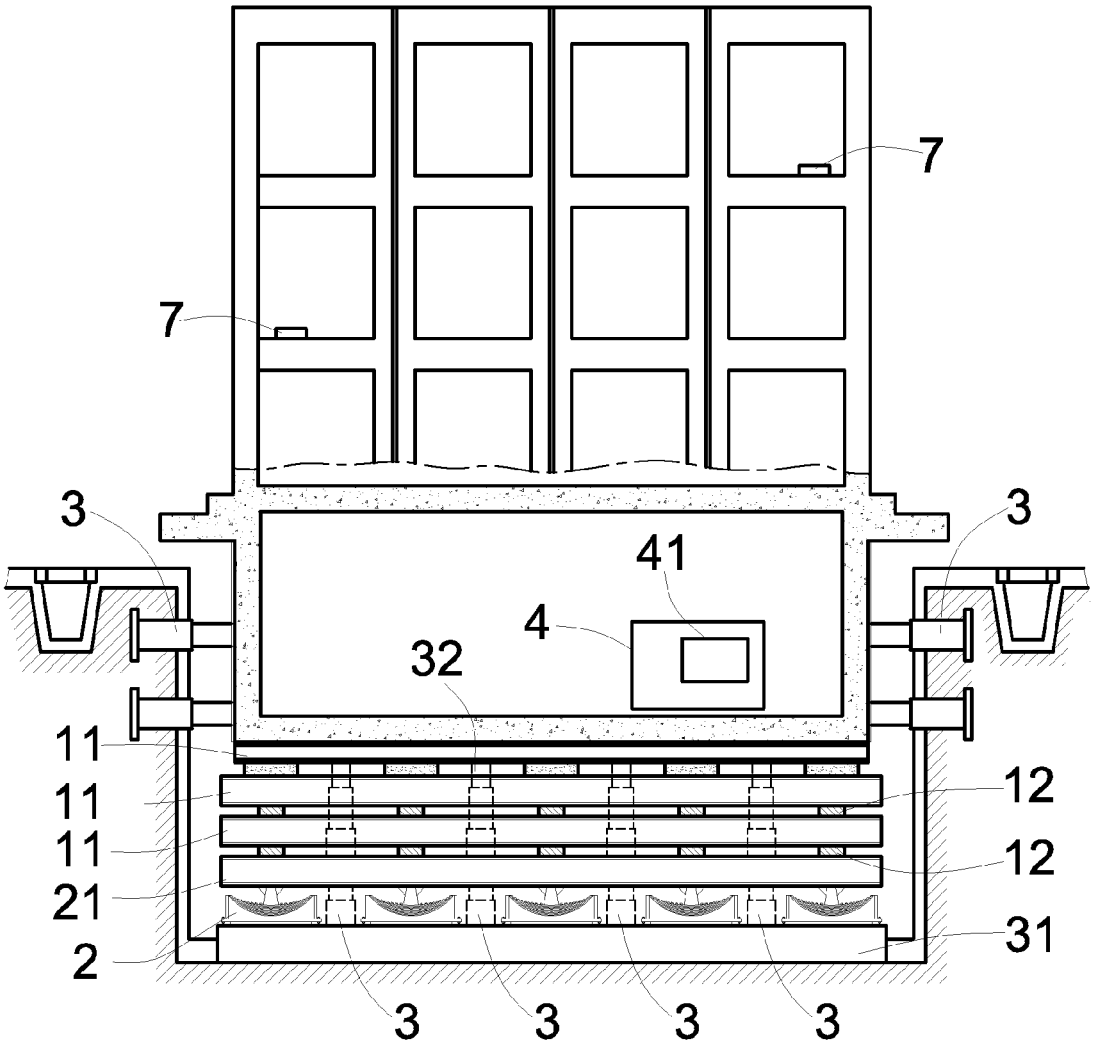
FIG. 17 is another embodiment of the hydraulic oil pressure systems in the present invention to illustrate damping forces adjusted by some sectionalized second hydraulic units between the first and the second bearing carriers to protect a building.

Referring to FIG. 17 which illustrates another embodiment of the hydraulic bearing structure and the hydraulic oil pressure systems 3 further comprising second hydraulic units 32 in the present invention of a building's seismic isolation and snubber system wherein the second hydraulic units 32 and the hydraulic oil pressure systems 3 are installed on the second bearing carrier 21 and the third bearing carrier 31 respectively and activated by the processing unit 4, and a sliding shoe 22 on the multilayer stack structure 23 reciprocally swings with horizontal vibrations during an earthquake detected; then, the present invention is to detect any dip and control the priority of corresponding damping forces with respect to the hydraulic oil pressure systems 3 and the second hydraulic units 32 based on stage treatment by which any tiny oblique angle attributed to seismic waves is eliminated via proper damping forces.

Alternatively, the hydraulic oil pressure systems 3 and the second hydraulic units 32 between the first bearing carriers 11 (both with functions described hereinabove) are integrated to sustain a building wherein the hydraulic oil pressure systems 3 keep the building non-collapsed and the second hydraulic units 32 adjust damping in stage treatment during an earthquake, so as to deliver seismic isolation with a building's vertical and horizontal vibrations effectively eliminated via damping distributed to the hydraulic oil pressure systems 3 and the second hydraulic units 32 between the first bearing carrier 11. Furthermore, some wear-resistant sliding materials applied, plated or stuck between any two sliding contact surfaces in the multilayer sliding system 2 (i.e., between a sliding shoe 22 and a dish gliding slab 231, between any two dish gliding slabs 231 and between a dish gliding slab 231 and a socket 24) contribute to any coefficient of kinetic friction in a multilayer sliding system 2 substantially reduced; any kinetic energy coming from earthquake-induced horizontal vibrations but transmitted between the layers of low-frictional sliding elements are geometrically decayed and finally absorbed by any snubber on the top of a first bearing carrier 11 so that there is very little vibrational energy accepted by a building to realize an earthquake-free building. In addition, a building could return to its lowest and most stable position with an earthquake finished owing to earthquake-induced horizontal kinetic energy transferred to a building's vertical potential energy by the dish gliding slabs 231.

Figure 18:
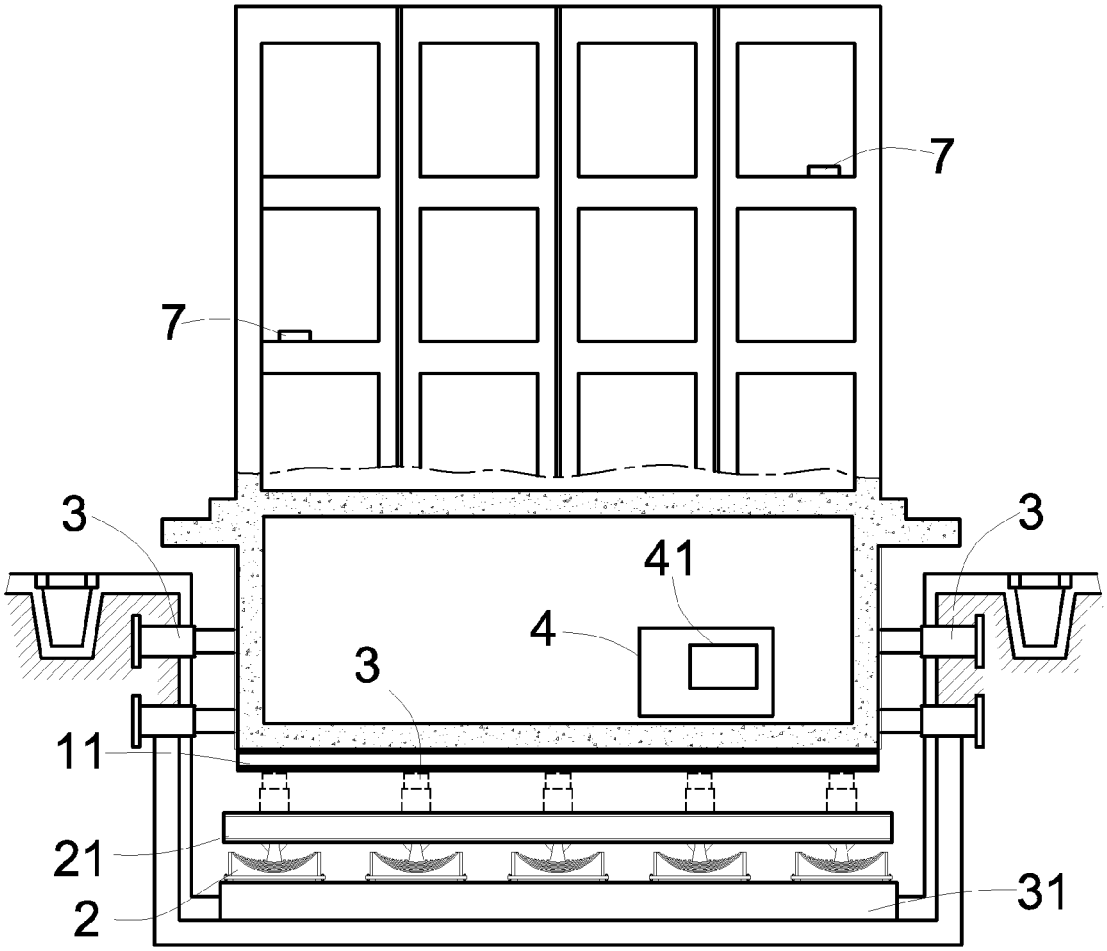
FIG. 18 illustrates another embodiment of the present invention.
Figure 19:
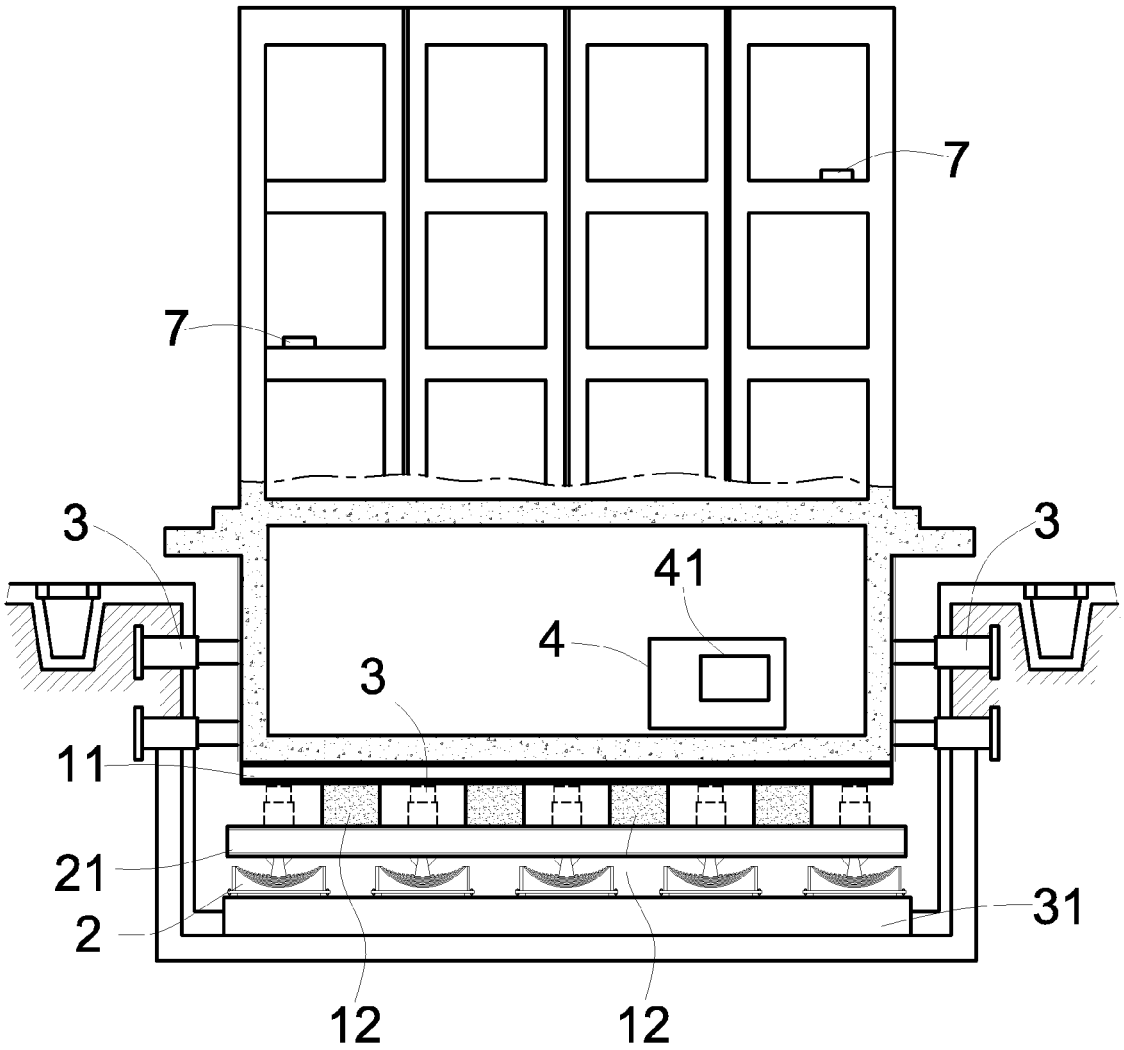
FIG. 19 illustrates another embodiment based on the embodiment shown in FIG. 18 and incorporating snubbers to yield or eliminate vertical vibrations.
Figure 21:
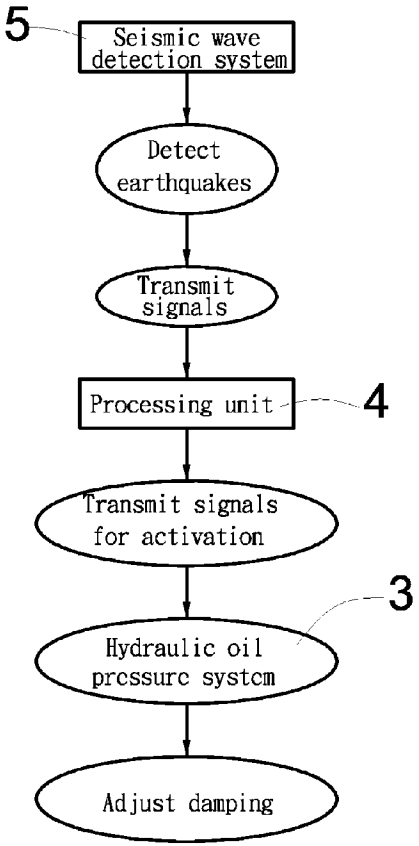
FIG. 21 is the block diagram of the seismic wave detection system for the present invention activated.

FIG. 18 illustrates another embodiment of the present invention wherein the hydraulic oil pressure systems 3 could be transferred to a seismic isolation mechanism eliminating any vertical vibration stress due to software of the processing unit 4 switched. FIG. 19 illustrates another embodiment based on the embodiment shown in FIG. 18 and incorporating snubbers 12 used in yielding or eliminating earthquake-induced vertical vibrations.

In contrast to other products manufactured in other prior arts, the present invention of a building's seismic isolation and snubber system has advantages as follows:

1. No additional crane is required during any maintenance owing to a building sustained and fixed by the hydraulic oil pressure systems 3 regularly.

2. The fact of a building's vertical and horizontal vibrations effectively reduced extends a service life of any hydraulic oil pressure system 3 because of earthquake-induced vibrational kinetic energy absorbed by snubbers 12.

3. Both horizontal and vertical seismic waves are preciously detected by sensors 7 along with the processing unit 4 which is effective in adjusting a coefficient of damping of any hydraulic oil pressure systems 3 for effective seismic isolation.

4. There is very little kinetic energy finally transmitted to a building due to damping increasingly or decreasingly adjusted by the hydraulic oil pressure systems 3 in multi-frequency and the present invention of a building's seismic isolation and snubber system ensuring a building's equilibrium without collapse and residents' lives and assets.

5. Any kinetic energy transmitted between the layers of low-frictional sliding elements have been geometrically decayed and finally absorbed by any snubber 12 on the top of one first bearing carrier 11 in design of the multilayer sliding systems 2 so that very little vibrational energy accepted by a building delivers an almost earthquake-free building.

6. Any small oblique angle coming from seismic waves or any earthquake-induced swing could be eliminated with damping forces gradually adjusted by the second hydraulic units 32, which are installed between first bearing carriers 11, in multi-frequency and stage treatment according to the priority of controlled damping forces; any damaged second hydraulic unit 32 is easily repaired or replaced.

7. With a communications device integrated, the seismic wave detection system 5 could transmit a signal to the processing unit 4 for the hydraulic oil pressure systems 3 along with a seismic isolation mechanism activated to eliminate any load applied on a building and ensure a building's safety.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A seismic isolation and snubber system for a building, comprising:

an absorber system installed under the building, comprising first bearing carriers with snubbers underneath and used to eliminate vertical and horizontal vibrations of the building;

a multilayer sliding system installed under the absorber system, comprising second bearing carriers with sliding shoes underneath, wherein each sliding shoe having a bottom contacting a multilayer stack structure composed of several units of dish gliding slabs, and positions of the several units being actively changed for yielding earthquake-induced horizontal vibrations;

hydraulic oil pressure systems arranged with the multilayer sliding system at regular intervals, used to sustain the building or eliminate a load applied on the building;

a processing unit electrically connected to the hydraulic oil pressure systems, receiving a seismic wave signal to activate each hydraulic oil pressure system for elimination of the load applied on the building, wherein the dish gliding slabs of each of the multilayer stack structures have concave surfaces and are sustained in an assembled state by a hemispheric socket, wherein the sliding shoe, a first dish gliding slab of the dish gliding slabs contacted by the sliding shoe, and each following dish gliding slab of the dish gliding slabs are in contact with one another and are sized that each multistack structure is formed with each adjacent sliding shoe, first dish gliding slab, and each following dish gliding slab are tightly in contact with each other.

2. The seismic isolation and snubber system according to claim 1, further comprising a seismic wave detector installed in the processing unit to detect an earthquake, transmit the seismic wave signal to a respective hydraulic oil pressure system, and activate the respective hydraulic oil pressure system to eliminate the load applied on the building.

3. The seismic isolation and snubber system according to claim 1, wherein the processing unit further comprising a sensor installed in the building for detection of oblique angles of the building and the processing unit connected to the sensor; the absorber system along with the hydraulic oil pressure systems and multilayer sliding system installed under the building for support of the building are characterized in that:

the sensor installed inside a quadrant unit of the building supplies an oblique angle to the processing unit which determines and controls a tilt by transferring the angle thereof to a damping coefficient of the hydraulic oil pressure systems in case of a strike or dip in a quadrant of operation and delivers the building's safety with equilibrium of the building distributed by hydraulic oil pressure systems' corresponding damping forces and earthquake-induced horizontal stress eliminated by the multilayer sliding system.

4. The seismic isolation and snubber system according to claim 3, wherein the processing unit drives one of the hydraulic oil pressure systems according to a strike or a dip detected in the quadrant of operation.

* * * * *